US009841214B2

(12) United States Patent
Weng et al.

(10) Patent No.: US 9,841,214 B2
(45) Date of Patent: Dec. 12, 2017

(54) PASSIVE ORGANIC WORKING FLUID EJECTOR REFRIGERATION METHOD

(71) Applicant: SHANGHAI JIAOTONG UNIVERSITY, Shanghai (CN)

(72) Inventors: Yiwu Weng, Shanghai (CN); Xiaojing Lv, Shanghai (CN); Ping Yang, Shanghai (CN); Yuzhang Wang, Shanghai (CN); Lei Tang, Shanghai (CN); Qianqian Zhang, Shanghai (CN)

( * ) Notice: Subject to any disclaimer, the term of this patent is extended or adjusted under 35 U.S.C. 154(b) by 288 days.

(21) Appl. No.: 14/874,432

(22) Filed: Oct. 4, 2015

(65) Prior Publication Data

US 2016/0025391 A1 Jan. 28, 2016

Related U.S. Application Data

(63) Continuation-in-part of application No. PCT/CN2013/085958, filed on Oct. 25, 2013.

(30) Foreign Application Priority Data

Oct. 15, 2013 (CN) ..... 2013 1 0483106

(51) Int. Cl.
*F25B 1/00* (2006.01)
*F25B 23/00* (2006.01)
(Continued)

(52) U.S. Cl.
CPC ..... *F25B 23/006* (2013.01); *F01K 3/004* (2013.01); *F01K 9/02* (2013.01); *F01K 25/08* (2013.01); *F25B 27/00* (2013.01); *F25B 41/00* (2013.01)

(58) Field of Classification Search
CPC . F01K 25/08; F01K 3/004; F01K 9/02; F25B 23/006; F25B 41/00
See application file for complete search history.

(56) References Cited

FOREIGN PATENT DOCUMENTS

CN 101871440 A * 10/2010

* cited by examiner

*Primary Examiner* — Len Tran
*Assistant Examiner* — Ana Vazquez
(74) *Attorney, Agent, or Firm* — Wayne & Ken, LLC; Tony Hom

(57) ABSTRACT

The present invention relates to a passive type organic working fluid ejector refrigeration method. The liquid organic working fluid of the reservoir is added to evaporator using gravity. Then the refrigerant absorbs heat during evaporation in the evaporator. When the refrigerant temperature and pressure increases to a certain value, the self-operated pressure regulator valve automatically opens and the ejector begins to work. After condensing in the condenser, the working fluid divided into two streams. One stream returns to the reservoir and the other one flows into the cooling evaporator of refrigeration cycle to produce chilled water about 12° C. When the liquid refrigerant is completely evaporated in the evaporator, the self-operated pressure regulator valve opens and the working fluid flows into the evaporator from the reservoir. A certain quality of the working fluid is closed in the evaporator, preparing for a new work cycle as above-mentioned. The system of the present invention can use organic fluid as the working fluid to utilize the low-temperature heat sources range from 60 to 200° C., using groundwater, river (sea) water or air as cold source and using gravity to transport liquid working fluid.

8 Claims, 2 Drawing Sheets

(51) Int. Cl.

| | |
|---|---|
| ***F01K 9/02*** | (2006.01) |
| ***F01K 3/00*** | (2006.01) |
| ***F01K 25/08*** | (2006.01) |
| ***F25B 27/00*** | (2006.01) |
| ***F25B 41/00*** | (2006.01) |

PASSIVE ORGANIC WORKING FLUID EJECTOR REFRIGERATION METHOD

CROSS-REFERENCE TO RELATED APPLICATIONS

This application is a continuation-in-part of International Patent Application No. PCT/CN2013/085958 with an international filing date of Oct. 25, 2013, designating the United States, now pending, and further claims priority benefits to Chinese Patent Application No. 201310483106.7 filed Oct. 15, 2013. The contents of all of the aforementioned applications, including any intervening amendments thereto, are incorporated herein by reference.

TECHNICAL FIELD

The present invention relates to the field of refrigeration engineering method, particularly to a passive type organic working fluid ejector refrigeration method.

BACKGROUND TECHNIQUE

Low temperature heat source usually refers to heat sources below 200° C. There are a variety and the huge amount of low temperature heat sources, including solar energy, geothermal energy and industrial waste heat. According to statistics, the solar radiation of two-thirds of the whole land area in China is greater than 5000 MJ per square meter. The geothermal energy in China can be equal to about 3.3 billion tons of standard coal. Since the low-temperature heat sources featured with a wide distribution and low quality it is difficult to be utilized by conventional energy conversion devices, resulting in that most of these energy vain discharged into the environment causing great waste and environmental pollution. Therefore, the exploration of technologies for rationally using these low temperature heat sources becomes such a hot topic in the field of energy technology. Organic working fluid power generation and ejector refrigeration system using organic working fluid is considered the most potential technology for the utilization of low temperature heat sources, which has a wide range of options, suitable cycle and high energy efficiency compared with the water vapor, when the heat source temperature is below 270° C.

The ejector refrigeration system appeared in the early 20th century, and there have been some applications. However, due to its low efficiency, bulky equipment and other reasons, it is gradually replaced by compact and more efficient compression refrigeration system. In recent years, however, the ejector refrigeration system again becomes a research focus in the field and attracts widespread concern. The ejector refrigeration system has several advantages. It does not contain moving parts and has a simple structure, reliable performance, easy maintenance, etc. The operating parameters of the refrigerant system are more suitable for low temperature heat sources such as solar energy, geothermal energy and industrial waste heat.

After searching for the existing literature, Huang B. J. et al published an article entitled "A solar ejector cooling system using refrigerant R141b" (B J Huang, J M. Chang "A solar ejector cooling system using refrigerant R141b." Solar Energy, 1998 (64)1223-226). This paper presents a new ejector refrigeration system program, which uses a high-performance ejector refrigeration unit with heat recovery. One-dimensional mathematical model of ejector proposed by previous researchers was improved, and the ejector refrigeration performance of the system was calculated to obtain a good cooling effect. Zheng Bin et al published an article entitled "A combined power and ejector refrigeration cycle for low temperature heat sources" (Zheng Bin, Y W Weng. "A combined power and ejector refrigeration cycle for low temperature heat sources" Solar Energy, 2010 (84): 784-791). The combined cycle will adopt expander and ejector, improving the efficiency of using the low temperature waste heat sources according to the energy cascade principle. The system uses latent heat of vaporization working fluid for cooling and improves performance of cooling and power generation system. Currently, the similar ejector refrigeration system for low temperature heat source has been extensively studied. The researches focus primarily on mathematical modeling, optimization of the ejector, and the ejector's experimental performance.

The traditional method of cooling has to work with external power. It needs pump to provide pressurized working fluid which consumes a lot of power. In addition, the control process also requires an external power supply, resulting in reduced overall system efficiency and increasing construction and maintenance costs.

DISCLOSURE

The object of the present invention is to overcome the above drawbacks of the prior art and to provide a non-active type organic working fluid ejector refrigeration method.

The purpose of the present invention can be achieved by the following technical solutions:

1. A method of the passive type organic working fluid ejector refrigeration comprises the following steps of:

(1) Through judging the low pressure in the evaporator, the first self-operated pressure regulator valve and the second self-operated pressure regulator valve are closed. The third self-operated pressure regulator valve is opened, the liquid organic working fluid of reservoir flows into the evaporator under the action of gravity until surface equilibrium. Then the third self-operated pressure regulator valve is closed, the liquid refrigerant will be closed in the evaporator;

(2) The liquid refrigerant absorbs heat and evaporates in the evaporator. The temperature and pressure of working fluid is increasing, until reaching 101° C. and 2 MPa. The first self-operated pressure regulator valve is opened, and the ejector begins to work;

(3) The refrigerant vapor is ejected into the condenser through the ejector and condenses to liquid. Then the working fluid is divided into two streams. One stream returns to the reservoir, and the other stream flows into the cooling evaporator of refrigeration cycle, by ejecting effect, resulting in cooling water of 12° C.;

(4) During operation process, the liquid refrigerant continues to absorb heat and evaporate in the evaporator constantly until completely evaporated, and the pressure drops to the set pressure of the first self-operated pressure regulator valve. Then The self-operated pressure regulator valve, and the working fluid flows into the evaporator from the reservoir;

(5) After the refrigerant liquid injection process, the third self-operated pressure regulator valve and the second self-operated pressure regulator valve are closed. The liquid refrigerant is closed again in the evaporator preparing for a new cycle repeated the above steps.

2. The injector includes a nozzle, entrained flow inlet, receiving chamber, the mixing chamber and diffuser cavity. The nozzle and entrained flow inlet were in the receiving chamber. The receiving chamber, mixing chamber and the diffuser cavity connect sequentially.

3. The reservoir's position is 100-1000 mm higher than the relative position of the evaporator, in order to use gravity transport of liquid refrigerant.

4. The system uses gravity to transport liquid medium and uses the self-operated pressure regulator valve and self-operated thermostatic regulator valve to control the entire ejection refrigeration process.

5. The organic liquid medium is R245fa, R600, R600a, R141b or R142b.

6. The entrainment ratio of ejector is from 0.1 to 0.5. The mass flow rate of working fluid of the ejector is 0.01 to 2.0 kg/s. The working pressure is 0.8-2.5 MPa.

7. The working pressure of condenser is the condensation pressure of liquid refrigerant at 10° C.-38° C. namely temperature range of the cooling water or cooling air.

8. The working pressure of the refrigerant evaporator is the corresponding evaporation pressure of liquid refrigerant with an evaporation temperature of 5° C.-15° C.

DETAILED DESCRIPTION

The present invention can use the low-temperature heat sources including industrial waste heat, solar hot water, geothermal energy etc. The temperature ranges from 60° C. to 200° C. Since the low-temperature heat sources featured with a wide distribution and low quality, it is difficult to be utilized by conventional energy conversion devices, resulting in that most of these low temperature heat sources vain discharged into the environment causing great waste and environmental pollution.

Compared with the prior technology, the present invention uses the organic working fluid in the evaporator to absorb heat during evaporation, so the evaporator pressure and temperature increases. When the working fluid pressure reaches the design pressure of the ejector, the first self-operated pressure regulator valve at the outlet of evaporator opens. The working steam flows into the ejector and produces ejecting effect, so that the pressure of refrigerant drops in the refrigeration evaporator. The refrigerant in the refrigeration evaporator is gasified with phase transition and the steam at outlet of refrigeration evaporator is ejected to the ejector and mixed with steam in a mixing chamber. After the diffuser cavity, the steam flows into the condenser to condense. A part of condensed liquid refrigerant flows into the reservoir, and the other part after the self-operated thermostatic valve flows into the cooling evaporator to absorb heat of cooling water, thus the water temperature decreases to 10-12° C., completing the refrigeration cycle. With the consumption of working steam in the evaporator, the evaporator pressure gradually drops to the set value of self-operated pressure regulator valve. The first self-operated pressure regulator valve and a second self-operated pressure regulator valve closes automatically. The third self-operated pressure regulator valve automatically opens, and liquid refrigerant of the reservoir flows back into the evaporator by gravity. Then the third self-operated pressure regulator valve is closed again, and the second self-operated pressure regulator valve opens and the next circulation begins.

The ejector refrigeration device uses gravity for the liquid medium transmission. The system can operate without working fluid pump, relying on the heat absorption and evaporation of working fluid in a closed space to increase pressure. The work process is controlled by self-operated pressure regulator valve and self-operated thermostatic regulator valve to achieve cooling effect. The groundwater, river (sea) water or air can be used as cold source.

DESCRIPTION OF DRAWINGS

Brief Description

DETAILED DESCRIPTION

Figure 1:
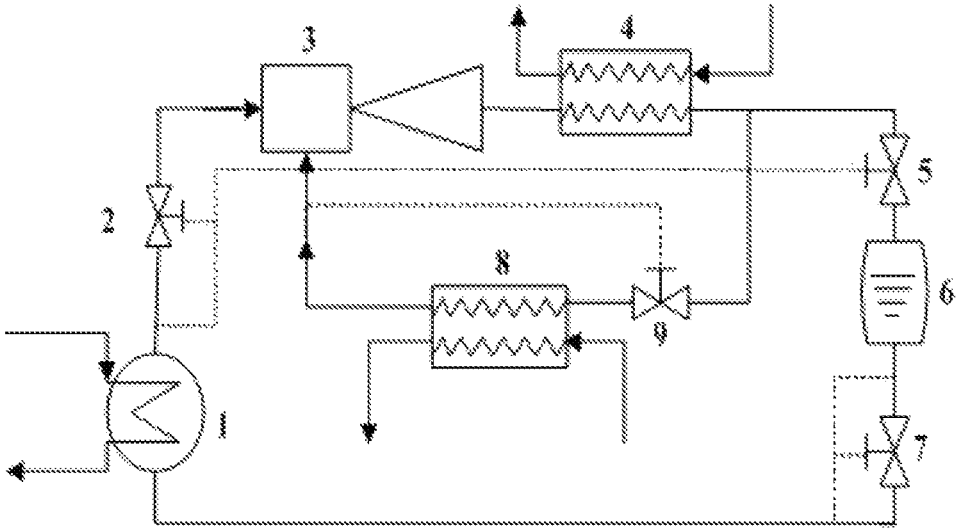
FIG. 1 is a schematic structural view of the invention the device.

Combining with the accompanying drawings and specific embodiments, the present invention will be described in detail.

EXAMPLE 1

This embodiment uses refrigerant R600a as working fluid. The temperature of heat sources is 120° C. The output temperature of chilled water is 12° C. The specific implementation steps are as follows:

First, the third self-operated pressure regulator valve is opened, the liquid organic working fluid in reservoir flows into the evaporator by gravity, until liquid surface equilibrium. After the third self-operated pressure regulator valve is closed, 100 kg working fluid is closed in the evaporator.

The second step, the liquid refrigerant in the evaporator absorbs heat during evaporation. The working fluid temperature and pressure is increasing, and ultimately achieves 101° C. and 2 MPa, namely, the design parameters of the ejector.

The third step, the first self-operated pressure regulator valve at the outlet of evaporator opens automatically under certain pressure. The steam as the working fluid with the mass flow rate of 0.175 kg/s flows into the ejector and produces ejecting effect for the gas at the outlet of refrigeration evaporator.

The fourth step, the lead working fluid mixes with the entrain stream in the mixing chamber. The mixing fluid flows into the diffuser chamber and then discharges from the ejection outlet, into the condenser. The outlet pressure and temperature of ejector working fluid are 0.438 MPa and 64.2° C.

The fifth step, the working fluid vapor is condensed into liquid in the condenser, and then divided into two streams. One stream flows into the reservoir, and the other one is throttled into the refrigeration evaporator through self-operated pressure regulator valve, then absorbs heat from the chilled water. The water temperature is cooled down to 12° C., completing the refrigeration cycle. The mass flow rate of refrigerant in refrigeration circuit is 0.03 Kg/s. The corresponding evaporation pressure and evaporation temperature are 0.21 MPa and 10° C. This process is controlled by self-operated temperature regulator valve.

The sixth step, the cooling evaporator provides chilled water of 12° C., and the output cooling capacity is 12 kW. The steam at outlet of refrigeration evaporator entrained by the ejector into the ejector inlet and mixed with work steam.

The seventh step, in the work process, the liquid refrigerant in the evaporator absorbs heat and evaporates constantly. After about 570 seconds, the fluid evaporates completely, and the evaporation pressure of refrigerant rapidly declines.

The eighth step, when the working fluid pressure drops to the set pressure of first self-operated pressure regulator valve, the first self-operated pressure regulator valve and a second self-operated pressure regulator valve is closed. The third self-operated pressure regulator valve opens, and the saturated liquid refrigerant of reservoir flows into the evaporator by gravity.

The ninth step, when the working fluid injection process finishes, the third self-operated pressure regulator valve and the second self-operated pressure regulator valve close automatically. A certain quality of the working fluid is closed in the evaporator for a new circulation. In this case, the cooling COP is about 0.31 and the cooling capacity is up to about 12 kW.

EXAMPLE 2

This embodiment uses refrigerant R245fa as working fluid. The temperature of heat sources is 120° C. The output temperature of chilled water is 12° C. The specific implementation steps are as follows:

First, the third self-operated pressure regulator valve is opened, the liquid organic working fluid in reservoir flows into the evaporator by gravity, until liquid surface equilibrium. After the third self-operated pressure regulator valve is closed, 100 kg working fluid is closed in the evaporator.

The second step, the liquid refrigerant in the evaporator absorbs heat during evaporation. The working fluid temperature and pressure is increasing, and ultimately achieves 100° C. and 1.26 MPa, namely, the design parameters of the ejector.

The third step, the first self-operated pressure regulator valve at the outlet of evaporator opens automatically under certain pressure. The steam as the working fluid with the mass flow rate of 0.175 Kg/s flows into the ejector and produces ejecting effect for the gas at the outlet of refrigeration evaporator.

The fourth step, the lead working fluid mixes with the entrain stream in the mixing chamber. The mixing fluid flows into the diffuser chamber and then discharges from the ejection outlet, into the condenser. The outlet pressure and temperature of ejector working fluid are 0.197 MPa and 64.9° C.

The fifth step, the working fluid vapor is condensed into liquid in the condenser, and then divided into two streams. One stream flows into the reservoir, and the other is throttled into the refrigeration evaporator through self-operated pressure regulator valve, then absorbs heat from the chilled water. The water temperature is cooled down to 12° C., completing the refrigeration cycle. The mass flow rate of refrigerant in circuit is 0.0525 Kg/s. The corresponding evaporation pressure and evaporation temperature are 0.08 MPa and 10° C. This process controlled by self operated temperature regulator valve.

The sixth step, the cooling evaporator provides chilled water of 12° C., and the output cooling capacity is 13 kW. The steam at outlet of refrigeration evaporator entrained by the ejector into the ejector inlet and mixed with work steam.

The seventh step, in the work process, the liquid refrigerant in the evaporator absorbs heat and evaporates constantly. After about 570 seconds, the fluid evaporates completely, and the evaporation pressure of refrigerant rapidly declines.

The eighth step, when the working fluid pressure drops to the set pressure of first self-operated pressure regulator valve, the first self-operated pressure regulator valve and a second self-operated pressure regulator valve is closed. The third self-operated pressure regulator valve opens, and the saturated liquid refrigerant of reservoir flows into the evaporator by gravity.

The ninth step, when the working fluid injection process finishes, the third self-operated pressure regulator valve and the second self-operated pressure regulator valve close automatically. A certain quality of the working fluid is dosed in the evaporator for a new circulation. In this case, the cooling COP is about 0.35 and the cooling capacity is up to about 13 kW.

EXAMPLE 3

This embodiment uses refrigerant R600a as working fluid. The temperature of heat sources is 120° C. The output temperature of chilled water is 12° C. The specific implementation steps are as follows:

First, the third self-operated pressure regulator valve is opened, the liquid organic working fluid in reservoir flows into the evaporator by gravity, until liquid surface equilibrium. After the third self-operated pressure regulator valve is closed, 1000 kg working fluid is closed in the evaporator.

The second step, the liquid refrigerant in the evaporator absorbs heat during evaporation. The working fluid temperature and pressure is increasing, and ultimately achieves 100° C. and 0.68 MPa, namely, the design parameters of the ejector.

The third step, the first self-operated pressure regulator valve at the outlet of evaporator opens automatically under certain pressure. The steam as the working fluid with the mass flow rate of 1.75 kg/s flows into the ejector and produces ejecting effect for the gas at the outlet of refrigeration evaporator.

The fourth step, the lead working fluid mixes with the entrain stream in the mixing chamber. The mixing fluid flows into the diffuser chamber and then discharges from the ejection outlet, into the condenser. The outlet pressure and temperature of ejector working fluid are 0.104 MPa and 70.4° C.

The fifth step, the working fluid vapor is condensed into liquid in the condenser, and then divided into two streams. One stream flows into the reservoir, and the other is throttled into the refrigeration evaporator through self-operated pressure regulator valve, then absorbs heat from the chilled water. The water temperature is cooled down to 12° C., completing the refrigeration cycle. The mass flow rate of refrigerant in circuit is 0.525 kg/s. The corresponding evaporation pressure and evaporation temperature are 0.043 MPa and 10° C. The process is controlled by self operated temperature regulator valve.

The sixth step, the cooling evaporator provides cooling water of 12° C., and the output cooling capacity is 130 kW. The steam at outlet of refrigeration evaporator entrained by the ejector into the ejector inlet and mixed with work steam.

The seventh step, in the work process, the liquid refrigerant in the evaporator absorbs heat and evaporates constantly. After about 560 seconds, the fluid evaporates completely, and the evaporation pressure of refrigerant rapidly declines.

The eighth step, when the working fluid pressure drops to the set pressure of first self-operated pressure regulator valve, the first self-operated pressure regulator valve and a second self-operated pressure regulator valve is closed. The third self-operated pressure regulator valve opens, and the saturated liquid refrigerant of reservoir flows into the evaporator by gravity.

The ninth step, when the working fluid injection process finishes, the third self-operated pressure regulator valve and the second self-operated pressure regulator valve close automatically. A certain quality of the working fluid is closed in the evaporator for a new circulation. In this case, the cooling COP is about 0.35 and the cooling capacity is up to about 130 kW.

The apparatus of the passive type organic working fluid ejector refrigeration method is shown in FIG. 1, comprising of: an evaporator 1, a first self-operated pressure regulator valve 2, the ejector 3, a condenser 4, the second self-operated pressure regulator valve-5, the reservoir 6, the third self-operated pressure regulator valve 7 the evaporator 8 and self-operated temperature regulator valve 9. Wherein: The reservoir 6 is connected to the evaporator 1 through the third self-operated pressure regulator valve 7. The evaporator 1 is connected to the inlet of injector 3 through the first self-operated pressure regulator valve 2. The outlet of ejector 3 is connected to the condenser 4 through a pipe. The pipes at outlet of the condenser 4 are divided into two ways. One way is connected to the reservoir 6, the another is connected the refrigeration evaporator 8 through self-operated temperature regulator valve 9. The outlet of refrigeration evaporator 8 is connected to the ejector body 3 through the pipes and inlet connector of entrained flow.

Figure 2:
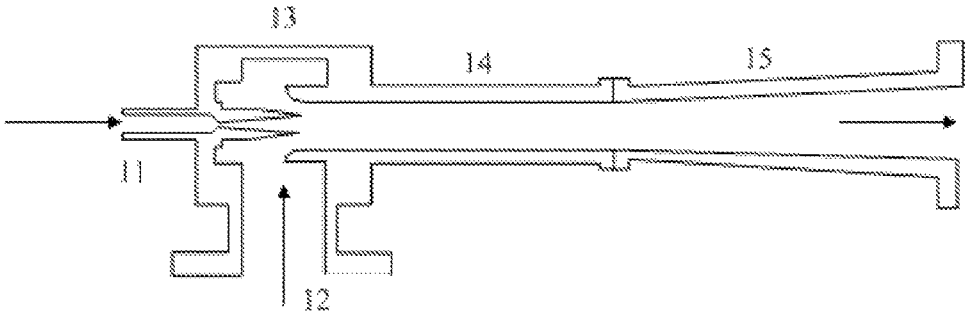
FIG. 2 is a schematic structural view of the ejector.

As shown in FIG. 2, The ejector 11 of the system consists of the nozzle 3, the inlet of entrained flow 12, the receiving chamber 13, the mixing chamber 14 and the diffuser cavity 15. The nozzle 11 and the inlet of entrained flow 12 are within the receiving chamber 13. The receiving chamber 13, the mixing chamber 14 and the diffuser cavity 15 is connected in sequence.

Next, the components will be further described: the location of the reservoir 6 is 100-1000 mm higher than that of the evaporator 1, which can take advantage of gravity to transfer liquid medium. The liquid refrigerant is organic working fluid such as R245fa, R600, R600a, R141b or R142b. The ejection coefficient of ejector 3 is from 0.1 to 0.5.The mass flow of the ejector 3 is 0.01-2.0 kg/s with a working pressure of 0.8-2.5 MPa. The working pressure of condenser 4 is the condensation pressure of liquid refrigerant at 10° C.-38° C., namely temperature range of the cooling water or cooling air. The working pressure of the refrigerant evaporator 8 is the corresponding evaporation pressure of liquid refrigerant with a evaporation temperature of 5° C.~15° C.

We claim:

1. A method of a passive type organic working fluid ejector in a refrigeration cycle, comprises the following steps of:

(1) through monitoring a low pressure in an evaporator, a first self-operated pressure regulator valve and a second self-operated pressure regulator valve are closed, a third self-operated pressure regulator valve is opened, a liquid organic working fluid of a reservoir flows into the evaporator under an action of gravity until surface equilibrium, then the third self-operated pressure regulator valve is closed, the working fluid will be closed in the evaporator;

(2) the working fluid absorbs heat and evaporates in the evaporator, a temperature and pressure of the working fluid is increasing until reaching 101 ° C. and 2MPa, the first self-operated pressure regulator valve is opened, and an ejector begins to work;

(3) vapor working fluid is ejected into a condenser through the ejector and condenses to liquid, then the working fluid is divided into two streams, one stream returns to the reservoir, and the other stream flows into the evaporator of the refrigeration cycle, by ejecting effect, resulting in cooling water of 12° C.;

(4) during operation process, liquid working fluid continues to absorb heat and evaporate in the evaporator constantly until completely evaporated, and the pressure drops to a set pressure of the first self-operated pressure regulator valve, then the third self-operated pressure regulator valve is opened, and the working fluid flows into the evaporator from the reservoir;

(5) after the operation process, the third self-operated pressure regulator valve and the second self-operated pressure regulator valve are closed, the liquid working fluid is closed again in the evaporator preparing for a new cycle repeating the above steps.

2. The method of the passive type organic working fluid ejector in the refrigeration cycle as set in claim 1, characterized in that wherein said ejector includes a nozzle, entrained flow inlet, receiving chamber, a mixing chamber and diffuser cavity; the nozzle and entrained flow inlet are within the receiving chamber; the receiving chamber, mixing chamber and the diffuser cavity connect sequentially.

3. The method of the passive type organic working fluid ejector in the refrigeration cycle as set in claim 1, characterized in that: wherein a reservoir's position is 100-1000 mm higher than a relative position of the evaporator, in order to use gravity to transport of the working fluid.

4. The method of the passive type organic working fluid ejector in the refrigeration cycle as set in claim 1, characterized in that: wherein the cycle uses gravity to transport liquid working fluid and uses the self-operated pressure regulator valves and a self-operated thermostatic regulator valve to control an entire ejection refrigeration process.

5. The method of the passive type organic working fluid ejector in the refrigeration cycle as set in claim 1, characterized in that: wherein said organic working fluid is R245fa, R60Q, R600a, R141b or R142b.

6. The method of the passive type organic working fluid ejector in the refrigeration cycle as set in claim 1, characterized in that: wherein an entrainment ratio of the ejector is from 0.1 to 0.5; a mass flow rate of the working fluid in the ejector is 0.01 to 2.0 kg/s; and a working pressure is 0.8-2.5MPa.

7. The method of the passive type organic working fluid ejector in the refrigeration cycle as set in claim 1, characterized in that: wherein a working pressure of the condenser is a condensation pressure of liquid working fluid at 10° C.-38° C., namely temperature range of a cooling water or cooling air.

8. The method of the passive type organic working fluid ejector in the refrigeration cycle as set in claim 1, characterized in that: wherein a working pressure of the evaporator is a corresponding evaporation pressure of liquid working fluid with an evaporation temperature of 5° C.-15° C.

* * * * *